US011313194B2

(12) United States Patent
Al Yahya

(10) Patent No.: US 11,313,194 B2
(45) Date of Patent: Apr. 26, 2022

(54) RETRIEVING A STUCK DOWNHOLE COMPONENT

(71) Applicant: Saudi Arabian Oil Company, Dhahran (SA)

(72) Inventor: Hany Al Yahya, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 49 days.

(21) Appl. No.: 16/879,088

(22) Filed: May 20, 2020

(65) Prior Publication Data

US 2021/0363849 A1 Nov. 25, 2021

(51) Int. Cl.
*E21B 31/113* (2006.01)
*E21B 47/12* (2012.01)

(52) U.S. Cl.
CPC ..... *E21B 31/113* (2013.01); *E21B 47/12* (2013.01)

(58) Field of Classification Search
CPC ..... E21B 31/113; E21B 31/1135
See application file for complete search history.

(56) References Cited

U.S. PATENT DOCUMENTS 4,333,542 A 6/1982 Taylor
5,086,853 A * 2/1992 Evans ..... E21B 31/113 175/297
5,398,753 A 3/1995 Obrejanu et al.
5,503,228 A * 4/1996 Anderson ..... E21B 31/1135 166/178
6,290,004 B1 * 9/2001 Evans ..... E21B 31/1135 166/178
6,481,495 B1 11/2002 Evans
(Continued)

FOREIGN PATENT DOCUMENTS

AU 2017261539 12/2017
CN 1902374 1/2007
CN 100507205 7/2009

OTHER PUBLICATIONS

PCT International Search Report and Written Opinion in International Appln. No. PCT/US2021/032967, dated Aug. 19, 2021, 15 pages.

(Continued)

*Primary Examiner* — Shane Bomar
(74) *Attorney, Agent, or Firm* — Fish & Richardson P.C.

(57) ABSTRACT

A wellbore assembly including a cable disposed within a wellbore and a fishing jar assembly coupled to the cable. The fishing jar assembly includes a housing assembly, a mandrel assembly, a fishing assembly, and an actuator. The housing assembly has an inwardly projecting shoulder defining an anvil surface and a hydraulic fluid chamber housing hydraulic fluid. The mandrel is movable along a central axis of the housing assembly and has an outwardly projecting shoulder that defines a hammering surface to strike the anvil surface. The mandrel assembly defines a piston disposed within the hydraulic fluid chamber. The fishing assembly engages a component stuck within the wellbore. The actuator moves the piston of the mandrel assembly along the longitudinal axis to pressurize the hydraulic fluid until the hydraulic fluid bleeds past a fluid port allowing the mandrel assembly to trip to strike the anvil surface with the hammering surface.

20 Claims, 2 Drawing Sheets

(56) References Cited

U.S. PATENT DOCUMENTS

| | | | | |
|---|---|---|---|---|
| 7,066,263 | B1 * | 6/2006 | Mouton | E21B 31/113 166/178 |
| 7,367,397 | B2 | 5/2008 | Clemens et al. | |
| 8,052,176 | B2 * | 11/2011 | Shears | E21B 31/1135 285/333 |
| 8,499,836 | B2 * | 8/2013 | Moriarty | E21B 47/12 166/301 |
| 8,813,876 | B2 | 8/2014 | Sallwasser et al. | |
| 9,644,441 | B2 * | 5/2017 | Hradecky | E21B 31/1135 |
| 10,190,394 | B2 | 1/2019 | Guo et al. | |
| 2002/0053434 | A1 * | 5/2002 | Chen | E21B 47/12 166/297 |
| 2003/0070842 | A1 * | 4/2003 | Bailey | E21B 31/107 175/24 |
| 2006/0054322 | A1 | 3/2006 | Rose | |
| 2006/0169456 | A1 | 8/2006 | Evans | |
| 2007/0089911 | A1 * | 4/2007 | Moyes | E21B 23/065 175/93 |
| 2011/0108285 | A1 * | 5/2011 | Fagley, IV | E21B 41/00 166/373 |
| 2013/0277057 | A1 * | 10/2013 | Evans | E21B 31/107 166/311 |
| 2015/0114643 | A1 | 4/2015 | McNeilly | |
| 2015/0204153 | A1 | 7/2015 | Steine | |
| 2018/0334874 | A1 * | 11/2018 | Massey | E21B 31/1135 |

OTHER PUBLICATIONS

Castillo et al., "Wireline operations all-inclusive risk management," SPE 189916-MS, Presented at the Coiled Tubing & Well Intervention Conference Exhibition, Mar. 27-28, 2018, The Woodlands, Texas; Society of Petroleum Engineers, 2018, 12 pages.

* cited by examiner

RETRIEVING A STUCK DOWNHOLE COMPONENT

FIELD OF THE DISCLOSURE

This disclosure relates to wellbores, in particular, to wellbore wireline fishing tools.

BACKGROUND OF THE DISCLOSURE

During drilling or production operations, wellbore equipment can fall into or get stuck in the wellbore due to differential pressures in the wellbore, equipment failure, and other related reasons. To recover parted or stuck downhole equipment, a fishing operation can be performed. Fishing equipment engages the stuck equipment, applies impact force to unstuck the equipment, and, with the equipment unstuck, pulls the equipment upward to the surface. Methods and equipment for improving fishing operations are sought.

SUMMARY

Implementations of the present disclosure include a wellbore assembly that includes a cable disposed within a wellbore and a fishing jar assembly coupled to a downhole end of the cable. The fishing jar assembly includes a housing assembly that includes an inwardly projecting shoulder defining an anvil surface. The housing assembly has a hydraulic fluid chamber that houses a hydraulic fluid. The fishing jar assembly also includes a mandrel assembly disposed at least partially inside the housing assembly and configured to move with respect to and along a central longitudinal axis of the housing assembly. The mandrel assembly has an outwardly projecting shoulder that defines a hammering surface configured to strike the anvil surface. The mandrel assembly defines a piston disposed within the hydraulic fluid chamber of the housing assembly. The fishing jar assembly also includes a fishing assembly coupled to the housing. The fishing assembly engages a component stuck within the wellbore to transmit impact force to the stuck component. The fishing jar assembly also includes an actuator fixed to the housing assembly and operationally coupled to the mandrel assembly. The actuator moves the piston of the mandrel assembly along the longitudinal axis to pressurize the hydraulic fluid until the hydraulic fluid bleeds past a fluid port allowing the mandrel assembly to trip to strike the anvil surface with the hammering surface to unstuck or release the component from the wellbore.

In some implementations, one of the housing assembly or the mandrel assembly has a compensating chamber fluidically coupled to the hydraulic fluid chamber. The compensating chamber receives the fluid bled past the fluid port.

In some implementations, the wellbore assembly also includes a transmitter disposed at or near a surface of the wellbore and communicatively coupled to the actuator. The actuator moves the mandrel assembly based on information received from the transmitter. In some implementations, the fishing assembly is communicatively coupled to the transmitter. The fishing assembly engages the stuck component based on information received from the transmitter.

In some implementations, the fishing jar assembly also includes a timer communicatively coupled to the actuator and configured to cycle the actuator between an extended position and a retracted position. The actuator resides uphole of the mandrel assembly and moves the piston of the mandrel assembly from a first position in which the hammering surface is disposed at a distance from the anvil surface, with the actuator extended, to a second position in which the mandrel assembly trips to strike the anvil surface, with the actuator retracted.

In some implementations, the cable comprises at least one of a wireline or a slickline. The wireline has an electrical cable that communicatively couples the fishing jar assembly to a transmitter at or near a surface of the wellbore.

In some implementations, the hammering surface of the outwardly projecting shoulder has an upwardly facing surface and the anvil surface has a downwardly facing surface. The hammering surface moves in an uphole direction to strike the anvil surface. In some implementations, the cable is configured to be in tension when the actuator moves the mandrel assembly to strike the anvil surface such that striking the anvil surface increases an upward force at the stuck component above a force holding the stuck component.

In some implementations, the actuator is an electro-mechanical actuator. The electro-mechanical actuator can be at least one of a downhole power unit tool or an electronic setting tool.

Implementations of the present disclosure include a jar assembly that includes a housing, a mandrel, and at least one of 1) an actuator or 2) a chemical fluid chamber. The housing is coupled to a downhole end of a cable disposed in a wellbore. The housing has an inwardly projecting shoulder that defines an anvil surface. The housing has a hydraulic fluid chamber that houses a hydraulic fluid. The housing engages a component stuck in the wellbore. The mandrel is disposed at least partially inside the housing and moves with respect to and along a central longitudinal axis of the housing. The mandrel has an outwardly projecting shoulder defining a hammering surface that strikes the anvil surface. The mandrel defines a piston disposed within the hydraulic fluid chamber of the housing. The least one of 1) an actuator or 2) a chemical fluid chamber is operationally coupled to the mandrel and moves the piston along the longitudinal axis to pressurize the hydraulic fluid until the hydraulic fluid bleeds past a fluid port allowing the mandrel to trip to strike the anvil surface with the hammering surface.

In some implementations, the jar assembly has the chemical fluid chamber. The chemical fluid chamber has a first chemical chamber housing a first chemical and a second chemical chamber housing a second chemical isolated from the first chemical. The chemical chamber moves the mandrel by mixing the first chemical with the second chemical to cause an expansive reaction of the chemicals. In some implementations, the chemical fluid chamber is communicatively coupled to a transmitter disposed at or near a surface of the wellbore. The chemical fluid chamber has a plate that fluidically separates the first chemical from the second chemical. The chemical fluid chamber opens, based on information received from the transmitter, a gate of the plate to mix the chemicals.

In some implementations, at least one of the housing or the mandrel has a compensating chamber fluidically coupled to the hydraulic fluid chamber, the compensating chamber configured to receive the fluid bled past the fluid port.

In some implementations, the jar assembly is communicatively coupled to a transmitter disposed at or near a surface of the wellbore. The at least one of the actuator or chemical fluid chamber moves the mandrel based on information received from the transmitter.

In some implementations, the jar assembly also includes a timer communicatively coupled to the at least one of the actuator or chemical fluid chamber. The timer activates, after a predetermined time period, the at least one of the actuator or chemical fluid chamber to move the mandrel.

In some implementations, the housing is attached to at least one of a wireline or a slickline. The wireline has an electrical cable configured to communicatively couple the jar assembly to a transmitter at or near a surface of the wellbore.

In some implementations, the actuator is an electro-mechanical actuator and the electro-mechanical actuator includes at least one of a downhole power unit tool or an electronic setting tool.

Implementations of the present disclosure also include a method of fishing a component disposed inside a wellbore. The method includes engaging, with a fishing jar housing assembly, the component. The housing assembly has 1) an inwardly projecting shoulder defining an anvil surface and 2) a hydraulic fluid chamber housing a hydraulic fluid. The method also includes moving, by an actuator disposed inside the housing assembly and operationally coupled to a mandrel assembly disposed at least partially inside the housing assembly, the mandrel assembly. The mandrel assembly has 1) an outwardly projecting shoulder defining a hammering surface that strikes the anvil surface and 2) a piston disposed inside the hydraulic fluid chamber. Moving the mandrel assembly includes moving the piston along a central longitudinal axis of the housing assembly to pressurize the hydraulic fluid until the hydraulic fluid bleeds past a fluid port allowing the mandrel assembly to trip to strike the anvil surface with the hammering surface to transmit impact force to the engaged component. The method also includes pulling, by a cable attached to the housing assembly, the housing assembly attached to the component to retrieve the component from the wellbore.

In some implementations, the method also includes, before moving the mandrel assembly, receiving, by the actuator and from a transmitter disposed at or near a surface of the wellbore and communicatively coupled to the actuator, instructions to move the mandrel assembly.

In some implementations, the method also includes, before moving the mandrel assembly, receiving a signal by the actuator from a timer communicatively coupled to the actuator to move the mandrel assembly. The timer is attached the fishing jar assembly.

DETAILED DESCRIPTION OF THE DISCLOSURE

The present disclosure describes a fishing jar assembly that can provide jarring blows to a stuck component without relying on overpull tension from the surface or without relying on the wireline weight of a wellbore string. The fishing jar assembly of the present disclosure produces jarring blows from within the jar assembly by using an electro-mechanical tool or actuator. The fishing jar assembly of the present disclosure is used in fishing operations as a single fishing jar or in conjunction with other jars. The fishing jar assembly provides a heavy blow to the stuck component attached to the jar assembly by transmitting, through the housing of the jar assembly, the impact force to the stuck component. The blow delivered by the jar is enough to knock loose the stuck component. To create a jarring blow with the jar assembly, the electro-mechanical actuator compresses hydraulic fluid by applying a steady force to the hydraulic fluid. Eventually, the jar trips when the hydraulic fluid bleeds past fluid ports and the arm of the actuator contracts, rapidly accelerating the mandrel assembly toward an anvil surface of the jar assembly. When a hammering surface of the mandrel assembly reaches full stroke, the anvil surface suddenly stops the hammering surface, stopping the motion energy of the jar. When the motion suddenly stops, the jar assembly converts the kinetic energy into impact force on the stuck point. This heavy upward blow can free the stuck component below the jar assembly and then the wireline can freely pull the object to surface. In some examples, the compression of fluid can be achieved by a chemical reaction.

Particular implementations of the subject matter described in this specification can be implemented so as to realize one or more of the following advantages. For example, by relying on upward pull by an actuator instead of the upward pull of a cable, the jar assembly is not limited by a line safe working load, avoiding the risk of wire cut. Additionally, the jar assembly is not limited by the performance of surface drums operating at high speeds and sudden stops. Applying upward force to the internal mandrel by an actuator of the jar assembly avoids loss of force in the wire, increasing the strength of the jarring blow. Additionally, the jar assembly of the present disclosure can be used with a low-tension electronic line, allowing the jar assembly to be electronically controlled from the surface. An additional advantage of the jar assembly is that the jar assembly allows fishing equipment at shallow depths (for example, less than 500 feet from the surface) because there is no distance requirement from the surface that is typically needed in overpull methods to reach the acceleration required of the wireline.

Figure 1:
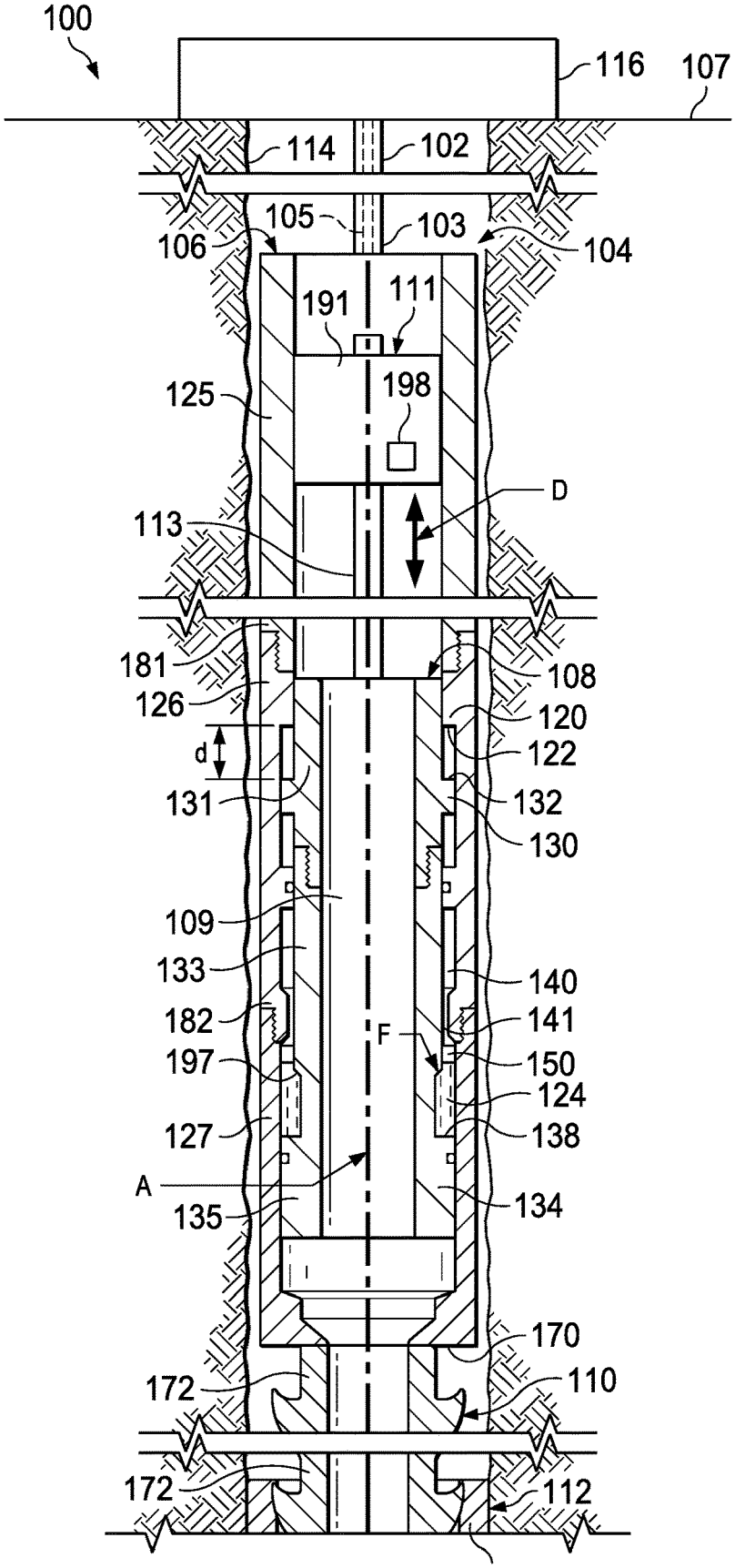
FIG. 1 is a front schematic view, partially cross sectional, of a wellbore assembly according to implementations of the present disclosure.

FIG. 1 shows a wellbore assembly 100 that includes a cable 102 disposed within a wellbore 114 and a fishing jar assembly 104 coupled to a downhole end 103 of the cable 102. The cable 102 can be, for example, a wireline or a slickline. The wireline can be or include an electrical cable 105 configured to communicatively couple the jar assembly 104 to a transmitter 116 residing at or near a surface 107 of the wellbore 114. The cable 102 can be attached to a wellhead (for example, to a production tree) that includes a cable drum that winds the cable to retrieve the fishing jar assembly 104. The transmitter 116 can transmit instructions to the jar assembly 104 to engage a stuck component 112 and to produce jarring blows.

The fishing jar assembly 104 includes a housing assembly 106, a mandrel assembly 108 disposed at least partially inside the housing assembly 106, a fishing tool or assembly 110, and an actuator 111. The fishing assembly 110 can be part of the housing assembly 106. The fishing assembly 110 engages the stuck component 112 to retrieve the component 112 from the wellbore 114. The fishing assembly 110 is attached to and disposed at a downhole end 170 of the housing assembly 106. The fishing assembly 110 can include, for example, an overshot or a spear 172 that engages a fish neck 174 of the stuck component 112. The particular type of fishing assembly depends on the operation and shape of the stuck component 112.

The housing assembly 106 can include one or multiple housings such as an actuator housing 125, an anvil housing 126, and a pressure housing 127. The actuator housing 125 is threadedly attached to the anvil housing 126 at a downhole end 181 of the actuator housing 125, and the anvil housing 126 is threadedly attached to the pressure housing 127 at a downhole end 182 of the anvil housing 126. The anvil housing 126 has an inwardly projecting shoulder 120 that defines a downwardly facing anvil surface 122. The pressure housing 127 defines a hydraulic fluid chamber 124 that contains or houses a hydraulic fluid 'F'.

The mandrel assembly 108 can include one or multiple mandrels such as a hammer mandrel 131 and a pressure mandrel 133. The mandrel assembly 108 moves with respect to and along a central longitudinal axis 'A' of the housing assembly 106 in an uphole and downhole direction. The hammer mandrel 131 has first outwardly projecting shoulder 130 that defines a hammering surface 132 that moves in an uphole direction to strike the anvil surface 122 of the anvil housing 126.

The pressure mandrel 133 has a second outwardly projecting shoulder 135 that forms a piston 134 (for example, an annular piston) disposed within the hydraulic fluid chamber 124 of the housing assembly 106. The piston 134 pressurizes the fluid 'F' between the shoulder 135 and a metering assembly 150 (for example, a metering sleeve) of the housing assembly 106. The piston 134 pressurizes the fluid 'F' when the actuator 111 moves the mandrel assembly 108 toward the metering assembly 150.

The actuator 111 is fixed to the housing assembly 106 and is operationally coupled to the mandrel assembly 108. The actuator can be disposed uphole of the mandrel assembly 108 and inside the housing assembly 106. The actuator 111 includes an arm 113 that extends from a housing 191 of the actuator 111 and is connected to the mandrel assembly 108. The arm 113 is extendable and retractable with respect to the actuator housing 191 to move the mandrel assembly 108. For example, the actuator 111 can be an electro-mechanical tool such as a non-explosive electro-mechanical tool (for example, a downhole power unit tool) or a non-pre-pressurized, non-pyrotechnic setting tool (for example, an electronic setting tool) used for the installation or setting of downhole tools in the wellbore. The actuator 111 can convert internal power (for example, electrical power) into a downward or upward axial force to mechanically move the mandrel assembly 108 to pressurize the hydraulic fluid 'F'. The actuator 111 delivers a steady force and does not deliver an impact. The steady force is stored as tensile load on the arm 113 and the mandrel assembly 108 until reaching the firing or tripping point leading to the impact at the anvil surface. The actuator 111 is configured to move the mandrel assembly 108 based on information received from the transmitter 116.

Specifically, the actuator 111 moves the mandrel assembly 108 to move the piston 134 of the mandrel assembly 108 along the longitudinal axis 'A' from a first position to a second position. In the first position, the arm 113 is extended, the fluid 'F' is pressurized and beginning to bleed past the metering assembly 150, and the hammering surface 132 of the mandrel assembly 108 is disposed at a distance 'd' from the anvil surface 122. Distance 'd' can be, for example, from 6 to 24 inches. In the second position, the arm 113 is retracted, an amount of fluid 'F' bled past the metering assembly 150 until the mandrel assembly trips, and the hammering surface 132 strikes the anvil surface 122. The housing assembly 106 transmits the impact energy to the stuck component 112 to help free the component 112 from the wellbore 114. Thus, the actuator 111 moves the piston 134 from the first position toward an end (for example, toward the metering assembly 150) of the hydraulic fluid chamber to the second position to pressurize the hydraulic fluid 'F'. Pressurizing the hydraulic fluid 'F' sets the arm 113 and the mandrel assembly 108 in tension until the mandrel assembly 108 trips and the hammering surface strikes the anvil surface 122 to provide a jarring blow to the stuck component 112. The mandrel can be retracted into its original position (to strike the anvil again) by relaying on gravity.

In some implementations, at least one of the housing assembly 106 and the mandrel assembly 108 have a compensating chamber 140 that receives the pressurized fluid 'F' that bleeds past the metering assembly 150. For example, the compensating chamber 140 can receive the fluid 'F' from the pressure chamber 124 as the piston 134 moves from the first position to the second position. The compensating chamber 140 can be formed between a reduced inner diameter of the housing assembly 106 and an outer diameter of the mandrel assembly 108. In some implementations, the fluid 'F' can bleed into a bore 109 of the mandrel assembly 108.

The metering assembly 150 can include one or more valves that open and close a fluid pathway of a fluid port 141 that fluidically couples the compensating chamber 140 to the pressure chamber 124. The hydraulic fluid 'F' is pressurized by the moving piston 134 until the fluid 'F' meters or bleeds past the metering assembly 150 from the high pressure chamber 124 into the compensating chamber 140 for any further upward movement of the piston 142 to occur. This delays the upward movement of the mandrel assembly 108 so that a strain can be taken in the mandrel assembly 108 and the arm 113 of the actuator 111. Once a shoulder 197 of the mandrel assembly 108 clears the metering assembly 150 or an otherwise larger fluid pathway is open into the compensating chamber 140, the mandrel assembly 108 is accelerated upward to cause a jarring blow in the upward direction. Thus, the actuator 111 causes the jarring blow without relying on tension applied by the cable 102 from the surface of the wellbore 114 to create a jarring blow.

The actuator 111 can also include a timer 198 that can cycle the actuator 111 between an extended position and a retracted position. The timer 198 can work in addition to or instead of the transmitter 116 to control the actuator 111. The timer 198 can be set by an operator at the surface 107 of the wellbore 114 before deploying the fishing jar assembly 104.

Figure 2:
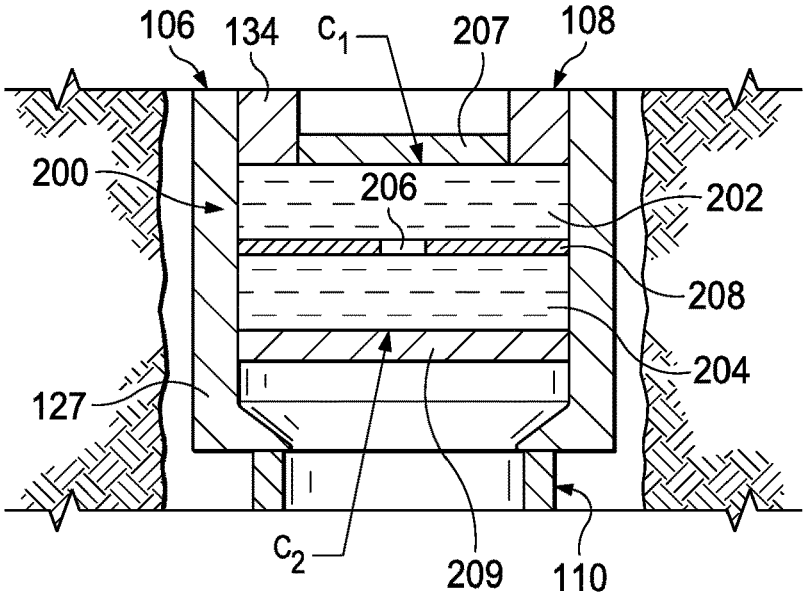
FIG. 2 is a front schematic view, cross sectional, of a portion of a wellbore assembly according to implementations of the present disclosure.

Referring also to FIG. 2, the mandrel assembly 108 can also be moved by a volume expansion of a chemical reaction. For example, instead of or in addition to the actuator 111, the housing assembly 106 can have one or more chemical fluid chamber 200 operationally coupled to (for example, in fluid contact with) the mandrel assembly 108. The chemical fluid chamber 200 can be disposed underneath the piston 134 of the mandrel assembly 108. The chemical fluid chamber 200 has a first chemical chamber 202 housing a first chemical '$C_1$' and a second chemical chamber 204 housing a second chemical '$C_2$' isolated from the first chemical '$C_1$'. The first chemical 'C1' can be separated from the bore 109 of the mandrel assembly 108 by a plate 207 disposed at an end of the piston 134. The chemicals are fluidically separated by a plate 208 that can have a gate 206 that opens to mix the chemicals. When the chemicals are mixed, an expansive reaction occurs that moves the piston 134 to pressurize the hydraulic fluid until the mandrel assembly trips to strike the anvil surface. In some implementations, the housing assembly 106 can include multiple chambers 200 operationally coupled to the mandrel assembly 108 to move the mandrel assembly 108 multiple times.

Figure 3:
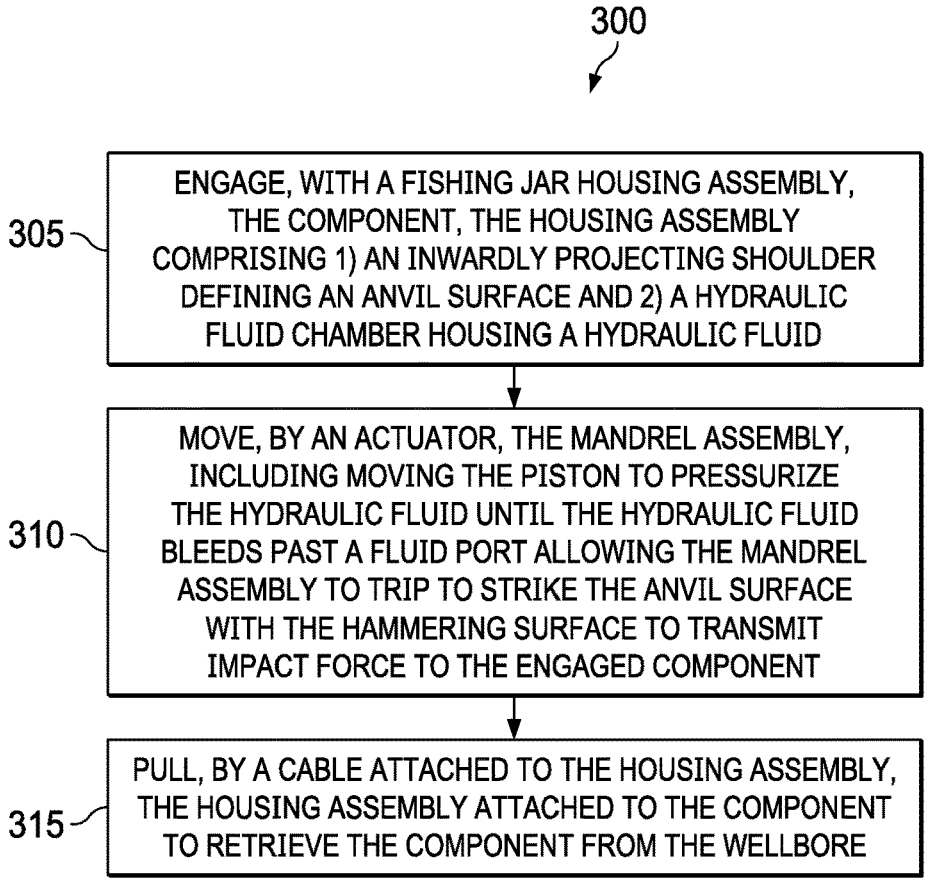
FIG. 3 is a flow chart of an example method of retrieving a stuck downhole component.

FIG. 3 shows a flow chart of a method 300 of fishing a component (for example, the stuck component 112 of FIG. 1) disposed inside a wellbore. The method includes engaging, with a fishing jar housing assembly, the component, the housing assembly comprising 1) an inwardly projecting shoulder defining an anvil surface and 2) a hydraulic fluid chamber housing a hydraulic fluid (305). The method also includes moving, by an actuator disposed inside the housing assembly and operationally coupled to a mandrel assembly disposed at least partially inside the housing assembly, the mandrel assembly. The mandrel assembly has 1) an outwardly projecting shoulder defining a hammering surface configured to strike the anvil surface and 2) a piston disposed inside the hydraulic fluid chamber. Moving the mandrel assembly includes moving the piston along a central longitudinal axis of the housing assembly to pressurize the hydraulic fluid until the hydraulic fluid bleeds past a fluid port allowing the mandrel assembly to trip to strike the anvil surface with the hammering surface to transmit impact force to the engaged component (310). The method also includes pulling, by a cable attached to the housing assembly, the housing assembly attached to the component to retrieve the component from the wellbore (315).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A wellbore assembly comprising:

a cable configured to be disposed within a wellbore; and a fishing jar assembly coupled to a downhole end of the cable, the fishing jar assembly comprising, a housing assembly comprising an inwardly projecting shoulder defining an anvil surface, the housing assembly comprising a hydraulic fluid chamber fluidly isolated from the wellbore and configured to house a hydraulic fluid, a mandrel assembly disposed at least partially inside the housing assembly and configured to move with respect to and along a central longitudinal axis of the housing assembly, the mandrel assembly comprising an outwardly projecting shoulder defining a hammering surface configured to strike the anvil surface, the mandrel assembly defining a piston configured to be disposed within the fluidly isolated hydraulic fluid chamber of the housing assembly, a fishing assembly coupled to the housing, the fishing assembly configured to engage a component stuck within the wellbore to transmit impact force to the stuck component, and an actuator fixed to the housing assembly and operationally coupled to the mandrel assembly, the actuator configured to apply an axial force to the mandrel and move the piston of the mandrel assembly along the longitudinal axis to pressurize the hydraulic fluid until the hydraulic fluid bleeds past a fluid port allowing the mandrel assembly to trip to strike the anvil surface with the hammering surface, wherein pressurizing the hydraulic fluid comprises pressurizing the hydraulic fluid only by the axial force applied by the actuator.

2. The wellbore assembly of claim 1, wherein one of the housing assembly or the mandrel assembly comprises a compensating chamber fluidically coupled to the hydraulic fluid chamber, the compensating chamber configured to receive the fluid bled past the fluid port.

3. The wellbore assembly of claim 1, further comprising a transmitter disposed at or near a surface of the wellbore and communicatively coupled to the actuator, the actuator configured to move the mandrel assembly based on information received from the transmitter.

4. The wellbore assembly of claim 3, wherein the fishing assembly is communicatively coupled to the transmitter, the fishing assembly configured to engage the stuck component based on information received from the transmitter.

5. The wellbore assembly of claim 1, wherein the fishing jar assembly further comprises a timer communicatively coupled to the actuator and configured to cycle the actuator between an extended position and a retracted position, the actuator residing uphole of the mandrel assembly and configured to move the piston of the mandrel assembly from a first position in which the hammering surface is disposed at a distance from the anvil surface, with the actuator extended, to a second position in which the mandrel assembly trips to strike the anvil surface, with the actuator retracted.

6. The wellbore assembly of claim 1, wherein the cable comprises at least one of a wireline or a slickline, the wireline comprising an electrical cable configured to communicatively couple the fishing jar assembly to a transmitter at or near a surface of the wellbore.

7. The wellbore assembly of claim 1, wherein the hammering surface of the outwardly projecting shoulder comprises an upwardly facing surface and wherein the anvil surface comprises a downwardly facing surface, the hammering surface configured to move in an uphole direction to strike the anvil surface.

8. The wellbore assembly of claim 7, wherein the cable is configured to be in tension when the actuator moves the mandrel assembly to strike the anvil surface such that striking the anvil surface increases an upward force at the stuck component above a force holding the stuck component.

9. The wellbore assembly of claim 1, wherein the actuator comprises an electro-mechanical actuator, the electro-mechanical actuator comprising at least one of a downhole power unit tool or an electronic setting tool.

10. A jar assembly comprising:

a housing configured to be coupled to a downhole end of a cable configured to be disposed in a wellbore, the housing comprising an inwardly projecting shoulder defining an anvil surface, the housing comprising a hydraulic fluid chamber fluidly isolated from the wellbore and configured to house a hydraulic fluid, the housing configured to engage a component stuck in the wellbore;

a mandrel disposed at least partially inside the housing and configured to move with respect to and along a central longitudinal axis of the housing, the mandrel comprising an outwardly projecting shoulder defining a hammering surface configured to strike the anvil surface, the mandrel defining a piston configured to be disposed within the fluidly isolated hydraulic fluid chamber of the housing; and at least one of 1) an actuator or 2) a chemical fluid chamber operationally coupled to the mandrel, the at least one of the actuator or chemical fluid chamber configured to apply an axial force to the mandrel and move the piston along the longitudinal axis to pressurize the hydraulic fluid until the hydraulic fluid bleeds past a fluid port allowing the mandrel to trip to strike the anvil surface with the hammering surface, wherein pressurizing the hydraulic fluid comprises pressurizing the hydraulic fluid only by a force applied by the actuator or the chemical fluid chamber.

11. The jar assembly of claim 10, wherein the jar assembly comprises a chemical fluid chamber, the chemical fluid chamber comprising a first chemical chamber housing a first chemical and a second chemical chamber housing a second chemical isolated from the first chemical, and wherein the chemical fluid chamber is configured to move the mandrel by mixing the first chemical with the second chemical to cause an expansive reaction of the chemicals.

12. The jar assembly of claim 11, wherein the chemical fluid chamber is communicatively coupled to a transmitter disposed at or near a surface of the wellbore, the chemical fluid chamber comprising a plate configured to fluidically separate the first chemical from the second chemical, the chemical fluid chamber configured to open, based on information received from the transmitter, a gate of the plate to mix the chemicals.

13. The jar assembly of claim 10, wherein at least one of the housing or the mandrel comprises a compensating chamber fluidically coupled to the hydraulic fluid chamber, the compensating chamber configured to receive the fluid bled past the fluid port.

14. The jar assembly of claim 10, wherein the jar assembly is communicatively coupled to a transmitter disposed at or near a surface of the wellbore, the at least one of the actuator or chemical fluid chamber configured to move the mandrel based on information received from the transmitter.

15. The jar assembly of claim 10, further comprising a timer communicatively coupled to the at least one of the actuator or chemical fluid chamber and configured to activate, after a predetermined time period, the at least one of the actuator or chemical fluid chamber to move the mandrel.

16. The jar assembly of claim 10, wherein the housing is attached to at least one of a wireline or a slickline, the wireline comprising an electrical cable configured to communicatively couple the jar assembly to a transmitter at or near a surface of the wellbore.

17. The jar assembly of claim 10, wherein the actuator comprises an electro-mechanical actuator, the electro-mechanical actuator comprising at least one of a downhole power unit tool or an electronic setting tool.

18. A method of fishing a component disposed inside a wellbore, the method comprising:

engaging, with a fishing jar housing assembly, the component, the housing assembly comprising 1) an inwardly projecting shoulder defining an anvil surface and 2) a hydraulic fluid chamber fluidly isolated from the wellbore and housing a hydraulic fluid;

moving, by an actuator applying an axial force to the mandrel, the mandrel assembly, the actuator disposed inside the housing assembly and operationally coupled to a mandrel assembly disposed at least partially inside the housing assembly, the mandrel assembly, the mandrel assembly comprising 1) an outwardly projecting shoulder defining a hammering surface configured to strike the anvil surface and 2) a piston disposed inside the hydraulic fluid chamber, wherein moving the mandrel assembly comprises moving the piston along a central longitudinal axis of the housing assembly to pressurize the hydraulic fluid until the hydraulic fluid bleeds past a fluid port allowing the mandrel assembly to trip to strike the anvil surface with the hammering surface to transmit impact force to the engaged component, wherein pressurizing the hydraulic fluid comprises pressurizing the hydraulic fluid only by a force applied by the actuator; and pulling, by a cable attached to the housing assembly, the housing assembly attached to the component to retrieve the component from the wellbore.

19. The method of claim 18, further comprising, before moving the mandrel assembly, receiving, by the actuator and from a transmitter disposed at or near a surface of the wellbore and communicatively coupled to the actuator, instructions to move the mandrel assembly.

20. The method of claim 18, further comprising, before moving the mandrel assembly, receiving a signal by the actuator from a timer communicatively coupled to the actuator to move the mandrel assembly, the timer attached the fishing jar assembly.

* * * * *